United States Patent [19]

Kirk

[11] Patent Number: 4,991,350

[45] Date of Patent: Feb. 12, 1991

[54] ELECTROMAGNETICALLY CONTROLLED CAT FLAP

[75] Inventor: Christopher P. Kirk, Middlesex, United Kingdom

[73] Assignee: Pet Mate Limited, Twickenham, United Kingdom

[21] Appl. No.: 402,810

[22] Filed: Sep. 1, 1989

[30] Foreign Application Priority Data

Jul. 16, 1988 [GB] United Kingdom ..... 8816980

[51] Int. Cl.[5] ..... E06B 11/00

[52] U.S. Cl. ..... 49/169; 49/394; 160/180; 160/2

[58] Field of Search ..... 49/169, 168, 394; 160/180, 116, 368.1, 2; 292/251.5; 340/567; 367/150, 93

[56] References Cited

U.S. PATENT DOCUMENTS

| | | | |
|---|---|---|---|
| 4,022,263 | 5/1977 | Beckett | 160/180 X |
| 4,134,110 | 1/1979 | Galvin | 367/93 X |
| 4,651,793 | 3/1987 | Davlantes | 49/169 X |
| 4,697,383 | 10/1987 | Hagiwara | 49/25 |
| 4,776,133 | 10/1988 | Green | 49/169 X |

*Primary Examiner*—Gary L. Smith
*Assistant Examiner*—Jerry Redman
*Attorney, Agent, or Firm*—Young & Thompson

[57] ABSTRACT

A pet door comprises a frame defining an aperture in which a flap is pivotally suspended so as to close the aperture when it hangs vertically. A pet such as a cat can push the flap either way to pass through the aperture when entering or leaving a house. Entry is controlled by a solenoid-operated catch which is energized when a magnet carried on a cat's collar enters the common detection zone of an array of reed switches disposed at the distal end of an extension of the bottom of the frame in spaced relation to the plane of the aperture.

8 Claims, 2 Drawing Sheets

ELECTROMAGNETICALLY CONTROLLED CAT FLAP

FIELD OF THE INVENTION

This invention relates to an electromagnetically controlled cat flap. By a "cat flap" is meant a small door set e.g. in a larger door or in a wall to permit the entrance or exit at will of a small domestic animal such as a cat. Cat flaps are frequently installed in houses to provide a means for the cat to enter or leave the house of its own will.

BACKGROUND OF THE INVENTION

A cat flap typically takes the form of a door pivotally mounted in a frame, the door being of a size such that the cat can readily push the door open. Gravity or a small spring force then returns the open door to its closed position in order to eliminate unwanted draughts.

One drawback of such cat doors that concerns many cat owners is that stray cats will often try to enter the house. In order to prevent this different forms of "selective" cat doors have been designed. Such designs ensure that the door is locked into the house by a latch that is rendered inoperative in response to an "operator" carried by the cat. A review of known solutions and their associated drawbacks will now be given:

British Patent No. 1567001 presents a solution utilising a magnetic responder linked to a latch member that is attracted towards an operator made of soft iron or to a bar magnet attached to the cat's collar. The principal drawback of this arrangement is that the responder and latch member have a very high inertia and will not always respond quickly enough to a cat's magnet passing over the magnetic responder. Thus the cat may not have deactivated the latch by the time that it presses the door against the latch. From this point on the friction of the latch against the door will prevent operation.

The same Patent also puts forward two other possible ways of producing a selective cat flap, although little detail is given. One solution is provided by using a magnetic switch. Such an arrangement, particularly when executed with a reed switch, overcomes the problem of slow response. It is also very cheap to produce as reed switches are available in quantity at very low cost. However, even with the most sensitive reed switches used in conjunction with the largest magnets a cat can practically carry the cat must be capable of reliably positioning its magnet within an approximately spherical envelope of response extending only 2.5 cm or so from the switch centre. This cannot be relied on in practice as cats will often wish to enter the door from different angles. It is not at all unusual, for instance, for a cat to enter a cat door by pressing at one or other of the sides of the door. Such behaviour could clearly cause a significant problem if there is no means to guide the operating magnet into sufficient proximity to a centrally mounted switch. It might be argued that a very narrow door might overcome the problem, but in practice if the door is constructed for a small cat it would be too narrow for a large cat to enter.

The problems of using a single magnetic switch are largely overcome by the remaining proposal of British Patent No. 1567001, namely by using an inductance loop extending around the opening in conjunction with a control circuit to detect change in inductance. The major problem with this solution lies in the high cost of production. It is also possible that such a system could be incorrectly triggered by, say, a cat wearing a steel address-carrying barrel or even by a buckle on a collar.

British Patent No. 1588673 presents a solution using a magnetically operable switch in conjunction with adjustable biassing means. In this way it is possible to render a single reed switch sufficiently sensitive to allow for the deficiencies of using a single, unbiassed switch. However, in practice such a solution demands relatively expensive circuitry to create a time delay and then energise a resetting coil positioned around the reed switch in order to reopen the reed switch, which could otherwise remain closed under the influence of the biassing magnet. Another disadvantage of this solution is that the adjustable biassing needs adjustment in situ to compensate for local magnetic effects. This can be awkward and is certainly an undesirable task for the cat owner to perform.

A further solution is provided by U.S. Pat. No. 4,022,263 in which the problem of encouraging the cat to enter the door centrally and thus come into sufficient proximity to a single unbiassed magnetically operable switch is achieved by mounting the switch on an external door taking the form of a flexible iris positioned in front of an interior, swinging door. The swinging door is normally retained by a solenoid catch such that when the catch is depressed the door swings out of position under force of gravity and is then free to allow the cat full entry into the house. The swinging door is recocked once the cat has passed through the door (in either direction). In practice it cannot be guaranteed that the cat's passage through the door will ensure that the swing door is recocked. Certainly if the cat passes slowly enough through the door such an action will not occur, thus rendering the flap non-selective. Another disadvantage of this solution relates to the expense of production—largely as a result of the two door construction. A further disadvantage of this system concerns the bulk of the unit, which renders it unsuitable for installation in a domestic door.

OBJECTS OF THE INVENTION

An object of the present invention is to provide a selective cat flap at minimum cost that overcomes the disadvantages associated with existing solutions.

SUMMARY OF THE INVENTION

In one aspect the invention provides a pet door comprising:

a frame, an aperture defined by the frame, the frame being adapted to be mounted in a generally upright attitude to control passage of a small animal through the aperture and whereby the frame has upper and lower members joined by lateral members, a flap pivotally mounted in the frame near said upper member so as to close said aperture when hanging in a rest position and being pivotable from said rest position to permit passage of said animal through said aperture, catch means on the frame movable between a first position obstructing movement of the flap in at least one direction and a second position not obstructing said movement of the flap, electrically operable means for displacing the catch means between said first and second positions, a source of electrical energy, circuit means interconnecting said source and said electrically operable means and a plurality of switch means included in said circuit means in such a way that closure of any one of said switch means will cause actuation of said electrically operable means, each said switch means being of a type which is normally open but which closes in response to the approach thereto of a magnetised or magnetisable element, said plurality of switch means being arranged in an array extending circumferentially of the aperture, the arrangement being such that when a magnetic or magnetisable element worn by a small animal is brought into proximity with one or more of said switch means the catch means is caused to release the flap.

The lateral of the frame preferably have an extent perpendicular to the plane of the aperture such that the aperture lies within a tunnel-like frame which will guide an animal seeking to pass through the aperture to approach the latter generally perpendicularly to the plane of the aperture.

Preferably said switch means are reed switches arranged substantially co-axially in the lower member of the frame to be substantially parallel with the plane of the aperture.

The lower member of the frame preferably comprises an extension projecting from the plane of the aperture oppositely to said at least one direction and the array of reed switches is preferably disposed at the distal end of the extension to be spaced from the plane of the aperture.

The said spacing of the common axis of the reed switches from the plane of the aperture is preferably approximately 10 cm.

The spacing of the reed switches from the plane of the aperture is preferably adjustable.

The interval between adjacent reed switches is preferably such that their detection zones overlap circumferentially of the aperture.

Each reed switch is preferably of 10 Ampere turns sensitivity and the centers of adjacent reed switches are preferably approximately 3 cm apart.

In another aspect the invention provides a pet door comprising a frame, an aperture defined by the frame, the frame being adapted to be mounted in a generally upright attitude to control passage of a small animal through the aperture and whereby the frame has upper and lower members joined by lateral members, all of said members having an extent on one side of and perpendicular to the plane of the aperture such as to provide a tunnel-like entry to said aperture as viewed from said one side thereof, a lip-like extension of the lower member of the frame projecting therefrom perpendicularly to the plane of the aperture on said one side thereof, a cheek piece extending from a lower region of each said lateral member of said frame to a respective end of said extension, an extension of the lower member of the frame projecting therefrom perpendicularly to the plane of the aperture, a flap pivotally mounted in the frame near said upper member so as to close said aperture when hanging in a rest position and being pivotable from said rest position to permit passage of said animal through said aperture, catch means on the frame movable between a first position obstructing opening movement of the flap and a withdrawn position, spring means biassing said catch means to the first position thereof, solenoid means arranged, when energised, to displace the catch means against said biassing means, a source of electrical energy, circuit means interconnecting said source and said solenoid means and a plurality of reed switches included in said circuit means in such a way that closure of any one of said reed switches will cause energisation of said solenoid means, said plurality of reed switches being arranged in mutually spaced, coaxial relation at the distal end of said extension to be parallel with and in spaced relation to the plane of the aperture, the interval between adjacent reed switches being such that their zones of detection overlap in the axial direction, the arrangement being such that when a magnetic or magnetisable element worn by a small animal is brought into proximity with one or more of said reed switches the solenoid is energised to release the catch means.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
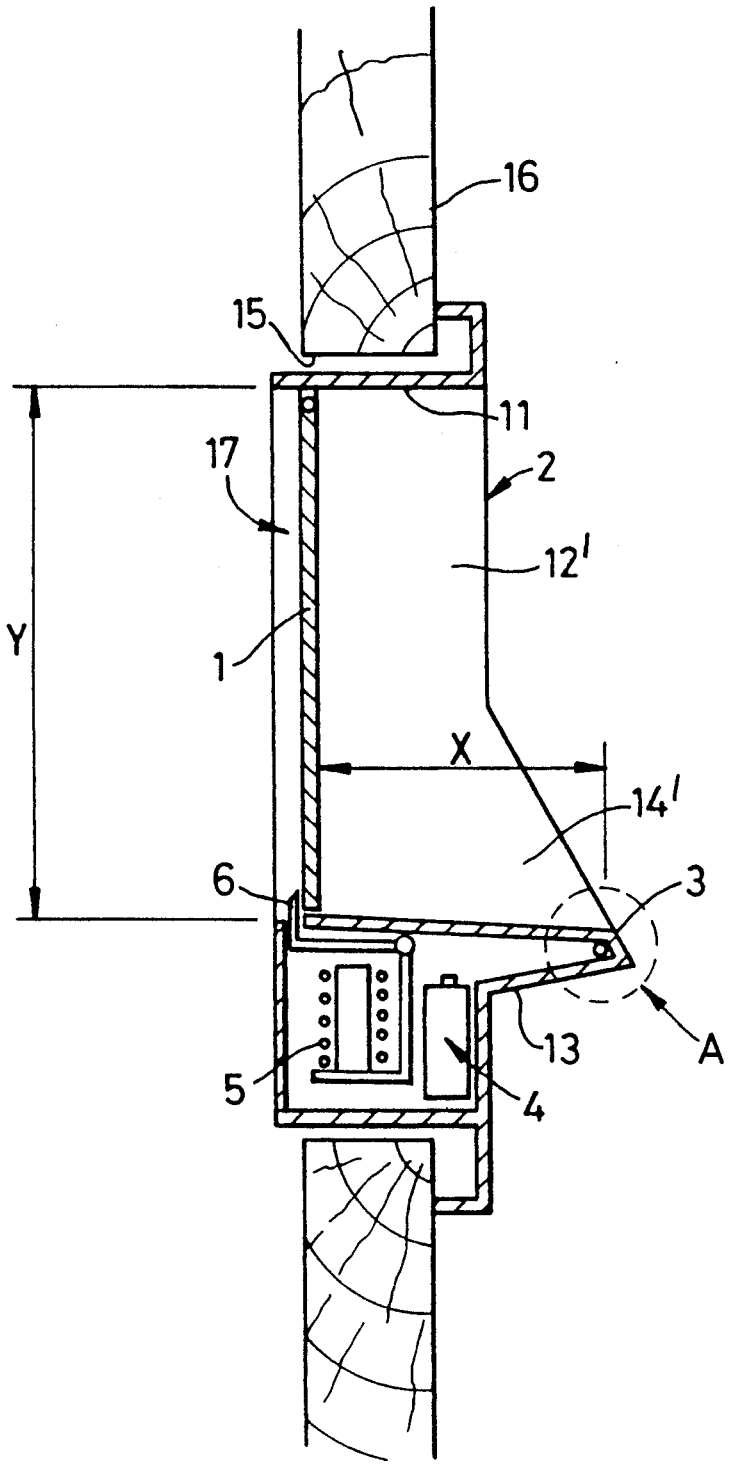
FIG. 1 is a sectional elevation of an electromagnetically controlled pet door installed in a house door.
Figure 2:
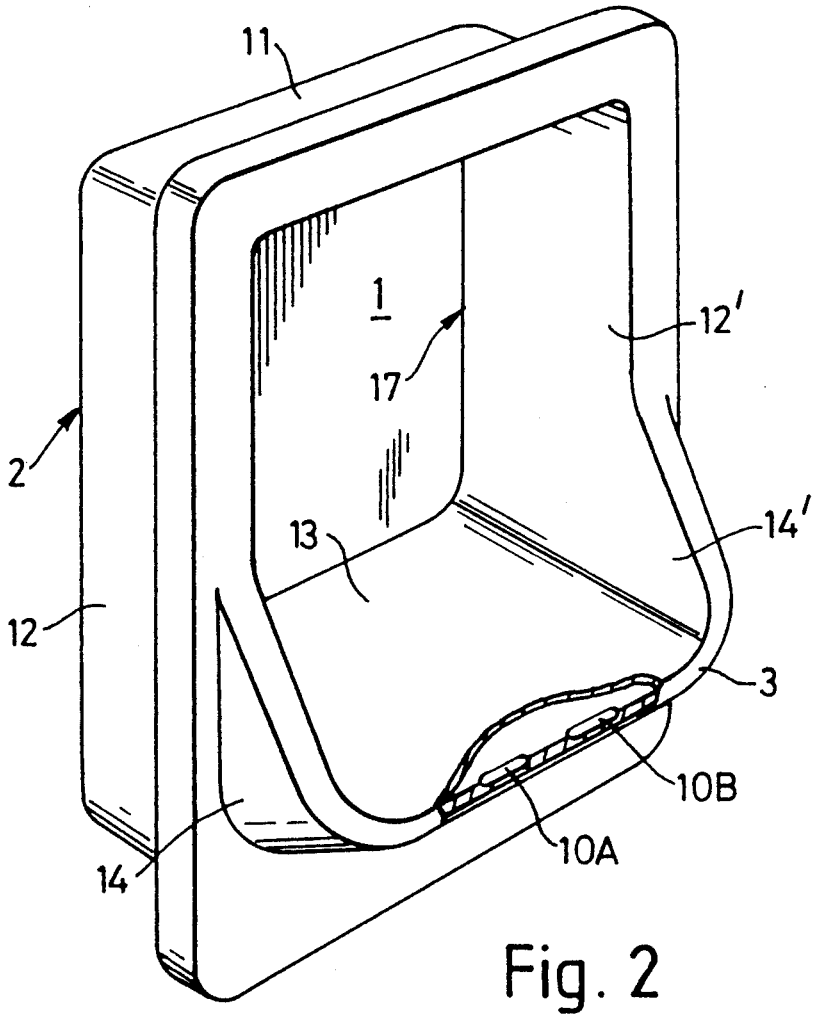
FIG. 2 is a perspective view of the frame of FIG. 1 with the door removed and partly broken away to show the location of two reed switches.

The pet door assembly illustrated comprises a flap 1 pivoted at its upper edge within a frame 2 fitted in an opening 15 in a house door 16. The frame 2 defines a generally rectangular aperture 17 which is closed by the flap 1 when the latter hangs upright as shown in FIG. 1. The frame 2 comprises top 11, side 12 and 12' and bottom 13 members, and it is to be noted that each of these frame members has a substantial extent on one side of the aperture 17 perpendicular to the plane of the latter. Moreover the bottom member 13 has an extension 3 projecting as a lip from the bottom of the frame 2 and the distal end of the extension 3 merges with the side members 12 and 12' over respective cheek pieces 14, 14' which also extend from the frame 2 as best seen in FIG. 2.

Figure 3:
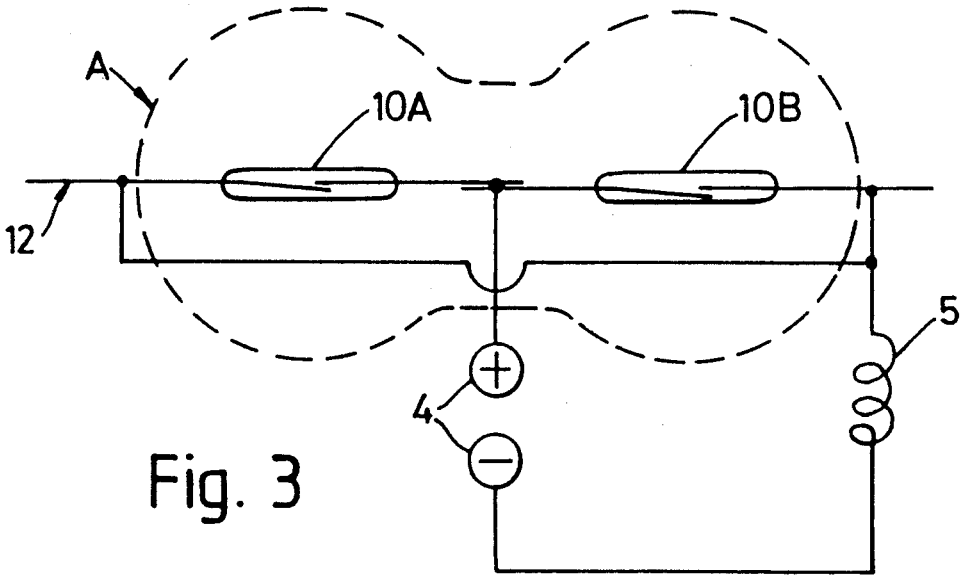
FIG. 3 is a circuit diagram of the electrical assembly.

Two normally open reed switches 10*a* and 10*b* of approximately 10 Ampere turns sensitivity are mounted coaxially in the distal edge of the extension 3, their common axis 12 being parallel with and spaced outwardly of the plane of the aperture 17. The reed switches are connected electrically in parallel (see FIG. 3) with a power source 4 and a solenoid 5 arranged to disengage a door catch 6 when energised. Connected in this way the reed switches can ensure a common detection zone elongated circumferentially of the frame 2, or extending across the desired width of the frame 2. To achieve such a common detection zone the centers of the reed switches 10*a*, 10*b* are spaced approximately 3.0 cm apart, dependant on the particular reed switch characteristics.

This ensures that the detection zones of the individual reed switches overlap, as shown, sufficiently to provide an almost "cylindrical" detection zone of approximately 2.5 cm radius extending approximately 2.5 cm from each end beyond the center points of the outermost reed switches and along the axis defined by the common longitudinal axes of the reed switches. The detection zone is indicated by the dotted line A in FIGS. 1 and 3.

When a magnet (not shown) carried on the collar of a cat approaching the flap 1 from the right as viewed in FIG. 1 enters this zone A at least one of the switches 10*a*, 10*b* will close, causing the solenoid 5 to be energised and in turn releasing the latch 6. The flap 1 can now be pushed open, swinging to the left as viewed in FIG. 1, as the cat continues through the opening 17.

A reliable assembly is easily mass produced if two critical dimensions of the cat door are carefully selected to suit the anticipated size range of cats likely to use it. Firstly the height Y of the aperture 17 should be kept to a minimum to ensure that a small magnet attached to the cat's collar will move into the detection zone A. Secondly the horizontal distance X from the plane of aperture 17 to the common axis 12 of the reed switches should be adjusted to a dimension similar to the horizontal distance from the cat's nose, which is used to push the flap 1 open, to the position in which a magnet normally hangs from its collar. In practice, for most cats, a dimension Y of approximately 15 cm has been found to be suitable and no adjustment would normally be necessary outside of this guideline. If necessary, in the case of an exceptionally tall cat, it would be possible to hang the magnet a little lower from the collar. Similarly the preferred dimension X is approximately 10 cm. This latter value of X is based on the largest cats likely to use such a door because, once one of the reed switches 10*a*, 10*b* has been closed hysteresis effects will keep the switch closed until the magnet is some 4 cm away from the switch, dependent on the characteristics of the particular reed switches chosen and the operating magnet used. In this way the latch 6 remains deactivated sufficiently for a small cat or kitten to push the flap 1 open with its nose before the latch 6 re-engages. However it is clear that the frame 2 could be provided with mechanical arrangements designed to adjust both the vertical height available over the reed switches 10*a*, 10*b* and the horizontal distance from the plane of the aperture 17 to the common axis 12 of the reed switches.

The door latch or catch 6 is lightly spring-loaded so as normally to prevent entry into the house. It is to be understood that the inside of the house door 16 is to the left as viewed in FIG. 1, and the pet door is installed so that the tunnel-like entry to the aperture 17 provided by the frame 2 extends to the outside. However, after the cat has passed through the aperture 17 to the inside of the house an angled face of the catch is struck by the returning flap 1 and depressed sufficiently to enable the catch to re-engage. In the embodiment illustrated it is not, of course, necessary for the catch 6 to be released when a cat is passing out of the pet door from left to right as viewed in FIG. 1. Closure of one or more of the reed switches 10*a*, 10*b* at this time will not matter. By the time the full length of the cat has passed through its magnet will no longer be in the zone A.

The cheek pieces 14 and 14' prevent a cat from approaching the aperture 17 obliquely when entering the house and combine with the tunnel-like entry presented by the frame 2 to constrain the cat to approach the flap 1 generally perpendicularly to the plane of the aperture 17. This ensures that the magnet on the cat's collar will pass within the detection zone A of the reed switches. The extension 3 permits positioning of the reed switches 10*a*, 10*b* at a sufficient spacing from the plane of aperture 17 to ensure that when the cat is pushing with its nose at the flap 1 a magnet on its collar will be as close as possible to the reed switches.

What is claimed is:

1. A pet door comprising:

a frame, an aperture defined by the frame, the frame being adapted to be mounted in a generally upright attitude to control passage of a small animal through the aperture and whereby the frame has upper and lower members joined by lateral members, a single closure defined by a flap, the flap being pivotally mounted in the frame near said upper member so as to close said aperture when hanging in a rest position and being pivotable from said rest position to permit passage of said animal through said aperture, said aperture being entirely open apart from said flap, catch means on the frame movable between a first position obstructing movement of the flap in at least one direction and a second position not obstructing said movement of the flap, electrically operable means for displacing the catch means between said first and second positions, a source of electrical energy, circuit means interconnecting said source and said electrically operable means and a plurality of switch means included in said circuit means in such a way that closure of any one of said switch means will cause actuation of said electrically operable means, each said switch means being of a type which is normally open but which closes in response to the approach thereto of a magnetised or magnetisable element, said plurality of switch means being arranged in an array extending circumferentially of the aperture in a portion of said frame members remote from said flap, the arrangement being such that when a magnetic or magnetisable element worn by a small animal is brought into proximity with one or more of said switch means the catch means is caused to release the flap.

2. A pet door as claimed in claim 1, wherein said switch means are reed switches arranged substantially co-axially in the lower member of the frame to be substantially parallel with the plane of the aperture.

3. A pet door as claimed in claim 2, wherein the lower member of the frame comprises an extension projecting from the plane of the aperture oppositely to said at least one direction and wherein the array of reed switches is disposed at the distal end of the extension to be spaced from the plane of the aperture.

4. A pet door as claimed in claim 3, wherein the said spacing of the common axis of the reed switches from the plane of the aperture is approximately 10 cm.

5. A pet door as claimed in claim 3, wherein the spacing of the reed switches from the plane of the aperture is adjustable.

6. A pet door as claimed in 2, wherein the interval between adjacent reed switches is such that their detection zones overlap circumferentially of the aperture.

7. A pet door as claimed in claim 2, wherein each reed switch is of 10 Ampere turns sensitivity and the centers of adjacent reed switches are approximately 3 cm apart.

8. A pet door comprising a frame, an aperture defined by the frame, the frame being adapted to be mounted in a generally upright attitude to control passage of a small animal through the aperture and whereby the frame has upper and lower members joined by lateral members, all of said members having an extent on one side of and perpendicular to the plane of the aperture such as to provide a tunnel-like entry to said aperture as viewed from said one side thereof, a lip-like extension of the lower member of the frame projecting therefrom perpendicularly to the plane of the aperture on said one side thereof and terminating in a free distal edge, a cheek piece extending from a lower region of each said lateral member of said frame to a respective end of said extension, a single closure defined by a flap, the flap being pivotally mounted in the frame near said upper member so as to close said aperture when hanging in a rest position and being pivotable from said rest position to permit passage of said animal through said aperture, catch means on the frame movable between a first position obstructing opening movement of the flap and a withdrawn position, spring means biassing said catch means to the first position thereof, solenoid means arranged, when energised, to displace the catch means against said biassing means, a source of electrical energy, circuit means interconnecting said source and said solenoid means and a plurality of reed switches included in said circuit means in such a way that closure of any one of said reed switches will cause energisation of said solenoid means, said plurality of reed switches being arranged in mutually spaced, coaxial relation at said distal edge of said extension to be parallel with and in spaced relation to the plane of the aperture, the interval between adjacent reed switches being such that their zones of detection overlap in the axial direction, the arrangement being such that when a magnetic or magnetisable element worn by a small animal is brought into proximity with one or more of said reed switches the solenoid is energised to release the catch means.

* * * * *